US005718621A

United States Patent [19]

Turley

[11] Patent Number: 5,718,621

[45] Date of Patent: Feb. 17, 1998

[54] REVERSIBLE ANGLE GRINDER WITH TOP ARBOUR LOCK

[76] Inventor: Edward Michael Turley, 400 Bennett Ave., Penticton, British Columbia, Canada, V2A 2P6

[21] Appl. No.: 713,003

[22] Filed: Sep. 11, 1996

[51] Int. Cl.[6] ..... B24B 23/02; B24B 41/04

[52] U.S. Cl. ..... 451/342; 451/358; 451/359; 451/360

[58] Field of Search ..... 83/651, 665, 666; 451/178, 259, 342, 343, 344, 352, 353, 358, 359, 360, 523

[56] References Cited

U.S. PATENT DOCUMENTS

| | | | |
|---|---|---|---|
| 108,801 | 11/1870 | Llewellyn . | |
| 922,049 | 5/1909 | Sanfason . | |
| 1,159,108 | 11/1915 | Schwartz . | |
| 1,162,970 | 12/1915 | Binford . | |
| 1,971,790 | 8/1934 | Mall | 451/359 |
| 2,213,432 | 9/1940 | McCartney . | |
| 2,426,170 | 8/1947 | Akers | 451/342 |
| 2,792,858 | 5/1957 | Bryant . | |
| 3,141,268 | 7/1964 | Seidel et al. | 451/342 |
| 3,192,695 | 7/1965 | Leydig et al. | 56/235 |
| 3,244,203 | 4/1966 | Leydig et al. . | |
| 3,691,900 | 9/1972 | Novak et al. | 451/342 X |
| 3,824,745 | 7/1974 | Hutchins | 451/359 |
| 4,380,270 | 4/1983 | Ludwig | 451/359 X |
| 4,434,586 | 3/1984 | Muller et al. | 451/358 |
| 4,597,227 | 7/1986 | Gentischer et al. | 451/342 |
| 4,779,382 | 10/1988 | Rudolf et al. | 451/342 |
| 4,989,374 | 2/1991 | Rudolf et al. | 51/168 |
| 5,058,909 | 10/1991 | Rudolf et al. | 451/342 X |
| 5,263,283 | 11/1993 | Rudolf et al. | 51/170 |
| 5,468,176 | 11/1995 | Udert et al. | 451/342 X |
| 5,601,483 | 2/1997 | Rudolf et al. | 451/342 X |

*Primary Examiner*—Timothy V. Eley
*Attorney, Agent, or Firm*—Graybeal Jackson Haley LLP

[57] ABSTRACT

An angle grinder with a reversible drive mechanism includes a hollow arbour with a bottom flange and a polygonal coupling piece which is keyed into a corresponding polygonal recess in the bottom of the arbour. A retaining bolt extends through the arbour and is threaded into the coupling piece. The coupling piece both couples the arbour and the retaining bolt for simultaneous rotation and retains the disk tool against the flange of the arbour. The retaining bolt is accessible by means of a slide which engages crenelations in the rim of the arbour to lock the arbour against rotation when accessing the retaining bolt.

11 Claims, 2 Drawing Sheets

REVERSIBLE ANGLE GRINDER WITH TOP ARBOUR LOCK

TECHNICAL FIELD OF THE INVENTION

This invention relates to angle grinders. More particularly, the invention relates to a disk tool coupling arrangement and to an arbour lock mechanism for angle grinders.

BACKGROUND ART

A conventional means of securing a disk tool to the drive in angle grinders is to screw a nut onto the shaft which drives the tool in order to wedge the tool between the shaft and the nut. An example of this approach is found in U.S. Pat. No. 108,801 to Llewellyn which discloses a planer having a tool and a hollow spindle. A rod extends vertically through the tool and is secured by a nut at the top. As the nut is tightened, the bottom of the rod wedges tool against the spindle.

A problem with the approach exemplified by Llewellyn is the tendency of the nut to loosen under the effect of torque induced between the shaft or bolt and the nut, notably the start and stop transitions. The problem of loosening of the screw or bolt described above was recognized in the context of dental grinding wheels in U.S. Pat. No. 1,162,970 to Binford. Binford addressed the problem by providing a square boss in the drive shaft of the device and a corresponding square hole in the tool, thereby eliminating the use of a threaded coupling. Binford however uses a screw on the grinding wheel side of the tool to clamp the grinding wheel to the shaft. This construction exposes the screw head to damage during operation.

Another approach to the problem of loosening of the nut is seen in U.S. Pat. No. 2,792,858 to Bryant for a power train for a tilt arbour saw. Bryant describes a conventional power saw blade assembly in which a nut is screwed onto a threaded shaft and secured by means of a set screw passing through the side of the nut and into the shaft driving the saw blade.

In U.S. Pat. No. 3,192,695 to Leydig et al, a tree trimmer is described which includes a spindle and a shaft going through it. The work piece end of the shaft has a head which frictionally engaged the work piece. The opposite end of the shaft is threaded. A nut is tightened to pull the head against the work piece. The spindle and shaft are keyed together by a tongue and grove arrangement so that they turn as a unit with the nut. A similar arrangement is used in U.S. Pat. No. 3,244,203, also to Leydig et al for a saw shaft assembly. A disadvantage of both the above patents is that the tension nut on the shaft, two washers and the entire shaft itself must be removed from the apparatus housing to change the cutting blade.

In U.S. Pat. No. 5,263,283 to Rudolf for a portable power tool, a clamping bolt is inserted in a hollow spindle such that the head of said bolt forms a flange which frictionally engages the disk tool against the flange at the lower section of the spindle. A separate retaining piece is screwed onto the threaded end of the bolt. A spring is provided between the retaining piece and the spindle to provide the tension to retain the tool. The bolt keys into the spindle. A disadvantage of the Rudolf patent is that the retaining bolt or shaft must be removed to effect changing of the disk tool. Moreover, numerous parts are required for the locking mechanism.

It is therefore a general object of the present invention to provide an improved angle grinder which will obviate the above mentioned disadvantages, notably the problem of loosening of the bolt, and the need to remove the whole bolt when changing the disk tool.

It is also an object of the present invention is to provide an angle grinder in which the direction of rotation of the disk tool may be reversed without causing the loosening of the disk tool securement. Such reversibility allows the grinder to be used in a greater variety of situations, and allows the operator to adjust the direction of rotation of the disk tool according to the torque induced in the grinder and the direction of deflection of the products of grinding, having regard to the space in which the operator is constrained to work.

Yet another object of the present invention is to provide an arbour locking mechanism which engages when the operator accesses the securement bolt for the purpose of removing the disk tool.

Yet a further object of the present invention is to provide an arbour locking mechanism which is accessible at the top of the grinder so as to avoid potential damage to the locking mechanism if the locking bolt is exposed on the disk tool end of a shaft.

Finally, it is an object of the present invention is to provide a grinder with a minimum and simple composition of parts.

SUMMARY OF THE INVENTION

The angle grinder according to the preferred embodiment of the invention includes a reversible motor driving a hollow arbour via a right angle bevel gear arrangement. The arbour has a right angle flange at its bottom. The flange abuts against one side of the disk tool. A retaining bolt is inserted such that the head of the bolt is countersunk into the top of the arbour. The bottom of the bolt screws into a coupling piece which is inserted into an enlarged bottom portion at the bottom of the arbour. The coupling piece is provided with a polygonal shape and is keyed into a corresponding polygonal shape of the enlarged portion at the bottom of the arbour. The hollow arbour, coupling piece, retaining bolt and disk tool are coupled by the coupling piece to rotate as a unit. The top of the apparatus has a slide mechanism which selectively exposes the head of the retaining bolt through the access aperture in the slide and simultaneously engages a downward projection in corresponding slots on the exterior surface of the arbour, effectively locking it against rotation.

In one of its aspects, the invention consists of an angle grinder for rotating a disk tool mounted at a tool end of said power tool. The angle grinder comprises a housing and a substantially hollow arbour mounted for rotation within said housing. A retaining bolt having a head and a threaded end extends longitudinally through the arbour such that the threaded end of the bolt is at the tool end of the arbour. The arbour includes a flange for frictionally engaging a first side of the disk tool. Means are provided for coupling the arbour to the retaining bolt. The coupling means includes means for engaging a second side of said disk tool.

In another of its aspects, the invention consists of such an angle grinder wherein the flange is annular and the means for engaging a second side of said disk tool comprises a flange. The means for coupling includes an enlarged recess at the tool end of said arbour hand a coupling piece adapted to be releasably engaged in said recess whereby said coupling piece simultaneously couples said arbour to said retaining bolt and engages said second side of said disk tool.

In another of its aspects, the invention consists of such an angle grinder wherein the flange on the coupling piece is disk shaped, and said coupling piece further includes an engagement portion extending radially from the central portion of the disk shaped flange, the engagement portion having a hollow interior threaded to receive the threaded end of the bolt. The enlarged recess at said tool end of said arbour includes interior polygonal walls and said engagement portion includes exterior polygonal walls corresponding in size and shape to said interior polygonal walls of said enlarged recess so as to enable coupling engagement of said coupling piece in said enlarged recess, and said housing includes a reversible motor for selectively driving said rotation of said disk tool in a clockwise or anti-clockwise direction, whereby said coupling piece simultaneously couples said arbour to said retaining bolt and retains said disk tool between said disk shaped flange of said coupling piece and said annular flange of said arbour.

In another of its aspects, the invention consists of an angle grinder for rotating a disk tool mounted at a tool end of said grinder. The grinder has a housing, a substantially hollow arbour having a tool end, a head opposite said tool end, and a rim about said head and a retaining bolt having a head and a threaded end and extending longitudinally through the arbour such that said threaded end of said bolt is disposed at the tool end of said arbour. An arbour locking mechanism is provided which comprises a lock piece slidingly mounted in said housing to slide in a direction perpendicular to the longitudinal axis of said arbour toward said rim, crenelations in the rim and a tang extending from the bottom surface of said lock piece, said tang being of a shape approximately corresponding to the shape of said crenelations, whereby the tang is engaged in one of said crenelations when the lock piece is slid toward said rim whereby to effectively lock the arbour against rotation.

In yet another of its aspects, the invention consists of the angle grinder described in the previous paragraph wherein the lock piece includes an aperture sufficiently wide to engage a bolt engaging tool therethrough and said aperture is located on said lock piece such that when said lock piece is slid toward said rim, said aperture is positioned directly over the head of said retaining bolt.

In yet another of its aspects, the invention consists of an angle grinder for rotating a disk tool mounted at a tool end of said power tool comprising a housing, a substantially hollow arbour mounted for rotation within said housing, said arbour having a tool end, a head opposite said tool end, a rim about said head and an annular flange for frictionally engaging a first side of said disk tool, a retaining bolt having a head and a threaded end, extending longitudinally through said arbour such that said threaded end of said bolt is disposed at the tool end of said arbour, means for coupling said arbour to said retaining bolt comprising an enlarged recess at the tool end of said arbour, a coupling piece adapted to be releasably engaged in said enlarged recess and a flange on said coupling piece for engaging a second side of said disk tool, whereby said coupling piece simultaneously couples said arbour to said retaining bolt and retains said disk tool between said flange on said coupling piece and said annular flange, a lock piece slidingly mounted in said housing to slide in a direction perpendicular to the longitudinal axis of said arbour toward said rim, crenelations in said rim, a tang extending from the bottom surface of said lock piece, said tang being of a shape approximately corresponding to the shape of said crenelations, whereby said tang is engaged in one of said crenelations when said lock piece is slid toward said rim whereby to effectively lock said arbour against rotation.

BRIEF DESCRIPTION OF THE DRAWINGS

The invention may be more fully appreciated by reference to the following description of the preferred embodiment and by reference to the drawings thereof in which.

DETAILED DESCRIPTION OF BEST MODE AND PREFERRED EMBODIMENT OF THE INVENTION

Figure 1:
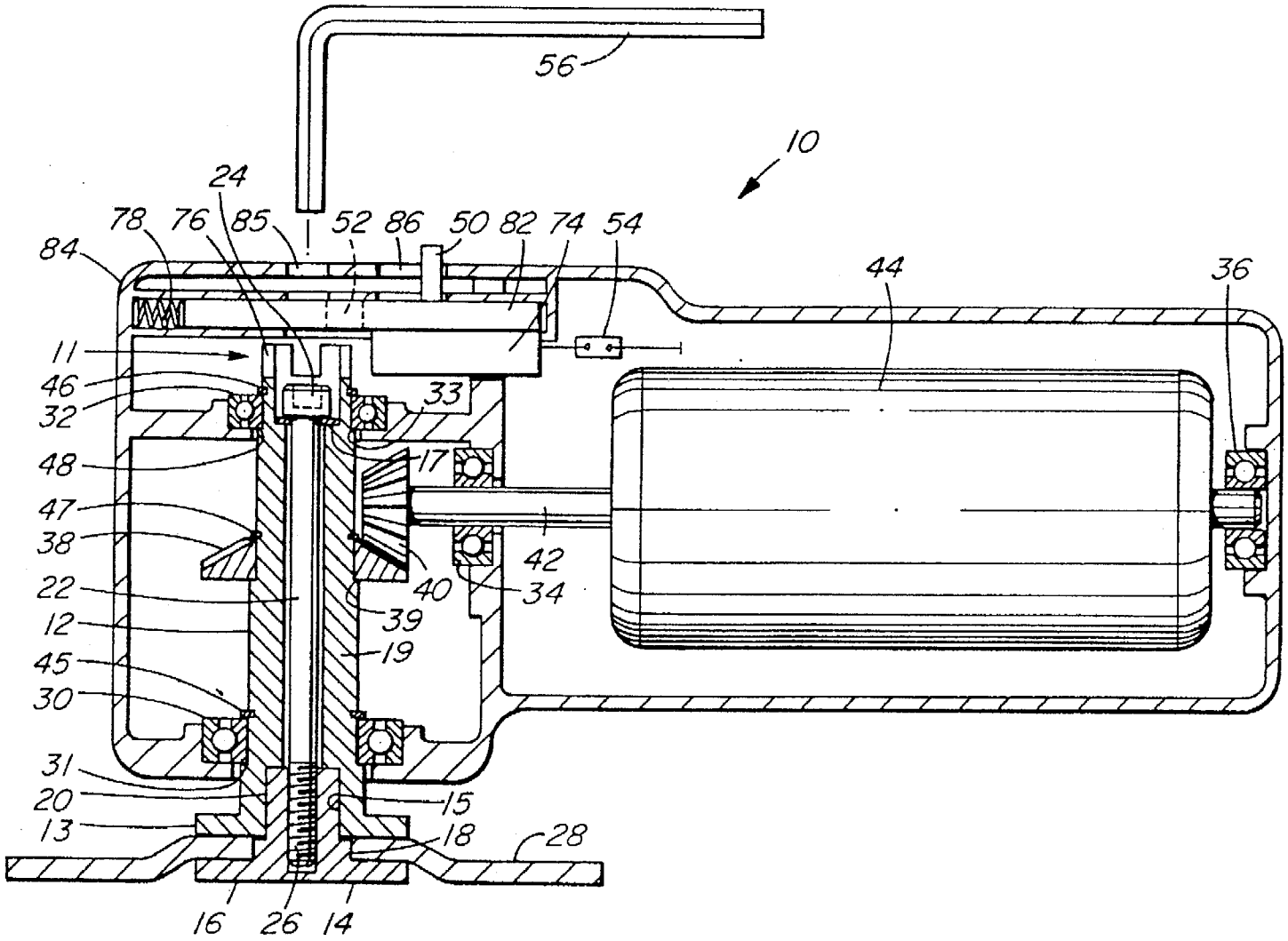
FIG. 1 is a longitudinal sectional view of an angle grinder according to the invention with arbour lock.

The preferred embodiment of the angle grinder with arbour lock according to the invention is depicted in FIG. 1 wherein the grinder in its entirety is designated by the numeral 10. The grinder 10 includes a rotatable arbour 12 which is secured for rotation in bearing 30 in the lower section of the arbour and bearing 32 in the upper section. The arbour 12 is machined such that there is a shoulder 31 in the lower portion of the arbour 12 exterior wall, a further shoulder 39 in the mid-portion of the arbour 12 exterior wall and a third shoulder 33 in the upper section of the arbour 12 exterior wall. The bottom surfaces of bearings 30 and 32, and bevel gear 38 abut against the arbour 12 respectively at shoulders 31, 33 and 39. Snap lings 45, 46 and 47 are inserted in horizontal grooves encircling the arbour 12 such that their bottom surfaces abut against the top surfaces of bearings 30 and 32, and bevel gear 38 respectively. Bearing 32 in the upper section and bearing 30 in the lower section abut the exterior surface of the arbour 12 and are secured to the apparatus housing 84 with adequate damping for vibration by means known to those skilled in the art.

The arbour 12 is hollow throughout its longitudinal extent so as to be capable of receiving a retaining bolt 22. Retaining bolt 22 extends from the head 11 of the arbour 12 to the region of the disk tool 28 and is oriented such that the head 24 of the bolt 22 is located in the head 11 of the arbour, opposite the disk tool end of the grinder. The head 11 of the arbour 12 is provided with crenelations 76 consisting of four equidistant square cut-outs. The interior hollow portion of the arbour includes a shoulder 17 separating the central portion 19 of the arbour from the head portion 11. The hollow interior of the head 11 is enlarged in relation to the central portion 19 and has a circumference sufficient to allow countersinking of the retaining bolt head 24 below the depth of the crenelations 76. A suitable lock washer 48 is seated between shoulder 17 and the retaining bolt head 24. At the disk tool end of the arbour 12, there is an enlarged coupler receiving portion 15 having an interior wall in a polygonal shape and terminating in a right angle flange 13.

Figure 2:
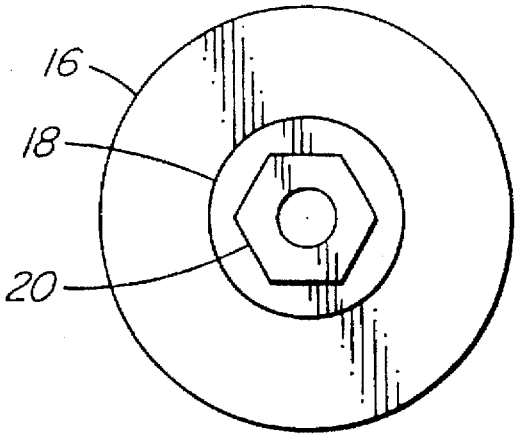
FIG. 2 is a plan view of the coupling piece according to the invention.

The coupler receiving portion 15 is adapted to receive a coupling piece 14. Coupling piece 14 may be more fully appreciated by reference to both FIG. 1 and FIG. 2. The coupling piece 14 is provided with an upper portion having a polygonal shape 20 corresponding in shape and size to the polygonal shape of the enlarged portion 15 of the arbour 12. The mid section of the coupling piece 14 is comprised of a disk pilot 18 which is circular. Disk pilot 18 consists of a radial shoulder at the flange 16 side of the coupler and has a circumference sized to snugly engage the standard central aperture of commercially available disk tools. The coupling piece 14 has a right angle flange 16 at its base which abuts against the bottom side of the disk tool 28. The interior of the coupling piece 14 is hollow with an interior circumference equal to that of the retaining bolt 22. The interior is tapped with threads and is closed with a base forming part of the coupler flange 16. In the preferred embodiment, the polygonal shape of the interior wall oft he coupler receiving portion 15 and of the coupler exterior 20 is hexagonal.

The bottom of the retaining bolt 22 (at the disk tool end) is threaded is at 26. The bottom of the bolt 26 screws into a coupling piece 14 which is inserted into coupler receiving portion 15. When coupling piece 14 is inserted into coupler receiving portion 15 and is firmly retained by retaining bolt 22, a disk tool 28 inserted by its central aperture over coupling piece 14 will be frictionally engaged and retained between arbour flange 13 and coupling piece flange 16.

The exterior of the arbour 12 includes a bevel gear 38 having teeth angled at forty-five degrees and a base extending horizontally and perpendicular to the arbour wall. A reversible electric motor 44 is connected to a drive shaft 42 which is mounted perpendicularly to the arbour 12 from bevel gear 38 to the rear of the housing 84. The drive shaft is inserted in bearing 36 at the rear section and in bearing 34 at the forward section. Bearings 36 and 38 are mounted on the apparatus housing by a means known to those skilled in the art. A bevel gear 40 is mounted at the forward extremity of the chive shaft 42 with teeth extending from the forward end of the shaft towards the rear at a forty-five degree angle below the horizontal with a vertical surface extending at a one-hundred and thirty-five degree angle to the drive shaft 42. The teeth of bevel gear 40 mesh with those of bevel gear 38 so as to effect a right angle transfer of force thereby rotating the arbour 12 in either forward or reverse directions about the arbour's longitudinal axis.

In operation an exterior power source engages electric motor 44. The electric motor 44 rotates in either forward or reverse shaft 42 direction as selected by the operator. The bevel gear 40 rotates in the corresponding direction and thereby rotates bevel gear 38 which is attached to the arbour 12. Rotation of the arbour 12, coupling piece 14, retaining bolt 22, disk tool 28, bevel gear 38, snap ring 16, and suitable lock washer 48 unit is thereby effected.

Torque applied through bevel gear 38 is transferred through the arbour 12 to the coupling piece 14 which frictionally engages the disk tool 28, thereby causing it to rotate. It will be appreciated that the structure disclosed herein is operable in either the clockwise or anti-clockwise directions. Such reversibility facilitates access to awkward locations and ensures that the operator can use the grinder such that accidental deflection of the tool, sparks or shavings will be away from the operator.

The arbour 12, coupling piece 14, retaining bolt 22, disk tool 28, bevel gear 38, snap ring 16, and suitable lock washer 48 are coupled to rotate as a unit. Coupling piece 14 transfers torque directly to the arbour 12 thereby avoiding differential torque between the retaining bolt and the arbour during start up, operation and shut down, which would otherwise tend to loosen the retaining bolt 22.

Coupling piece 14 serves several functions. It frictionally engages and retains the disk tool 28. It transfers torque between the arbour and the disk tool thereby avoiding the application of torque to the retaining bolt relative to the coupler piece. It also serves to retain the retaining bolt 22 in the arbour 12 even if the retaining bolt 22 were to become loose. This is due to the fact that the coupling piece 14 remains retained within the coupler receiving portion 15 (and thereby retains the disk tool 28) unless the retaining bolt 22 is completely unscrewed and disengaged from the coupling piece 14. In the case of mere loosening of the retaining bok 22, the disk tool 28 would not disengage from the grinder (with dangerous consequences) but would raffle thereby alerting the operator to tighten the retaining bolt 22. The use of coupling piece 14 also allows changing of the disk tool without requiring removal of the entire retaining bolt 22 from the arbour. The multiple functions of coupling piece 14 thereby result in a simpler constructed apparatus with a minimum of parts.

Figure 3:
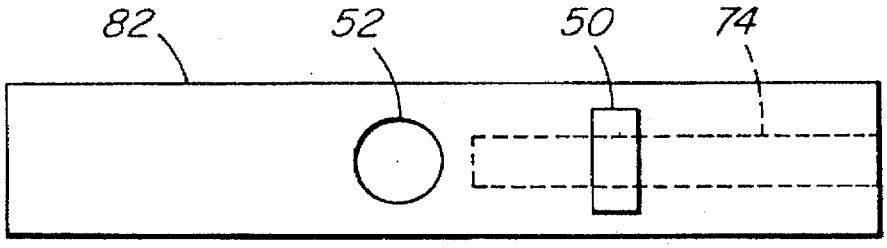
FIG. 3 is a plan view of the lock piece according to the invention.
Figure 4:
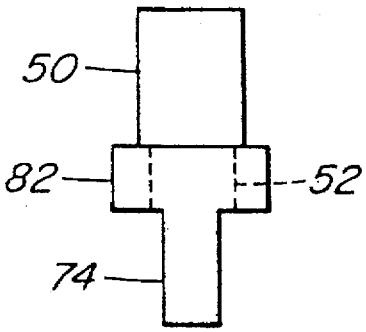
FIG. 4 is an end view of the lock piece according to the invention.

In the preferred embodiment, the top of the angle grinder 10 is provided with a lock mechanism which will now be described by reference to FIGS. 1, 3 and 4. A generally rectangular lock piece 82 is secured in housing 84 near the head of the arbour such that it may slide in a direction perpendicular to the longitudinal axis of the arbour 12. Lock piece 82 includes a lever 50 which extends from the top rear section of the lock piece 50 out of the housing 84 to allow manipulation by the operator. The top surface of the housing 84 includes two access apertures. The forward access aperture 85 which is sufficiently large to allow passage of a tool 56 (such as a wrench) therethrough is located directly above and centered on the head 24 of the retaining bolt 22. The rear access aperture 86 which is sufficiently large to allow passage of the lever 50 therethrough has a rear surface which abuts the rear surface of the lever 50 in the operating position of the lock piece 82 and a forward surface which abuts the forward surface of the lever 50 in the locking position of the lock piece 82.

Lock piece 82 includes an access aperture 52 which is sufficiently large to allow passage of a tool 56 (such as a wrench) therethrough. In the operating position, lock piece 82 is positioned substantially as illustrated in FIG. 1. In the locking position lock piece 82 is positioned such that the access aperture 52 is directly over the bolt 22. Lock piece 82 may be retained in the apparatus housing. 84 for example by means of two longitudinal grooves (not shown) about the sides of the lock piece 82 and stops (not shown) at the front and rear of the lock piece 82. A tang 74 having a square cross section extends from the rear portion of the bottom of the lock piece 82 and is sized such that it may engage the arbour 12 crenelations 76 when the lock piece 82 is slid into the locking position. Although not shown in the drawings, tang 74 and crenelations 76 may be tapered or beveled to facilitate engagement of tang 74 in crenelations 76.

The rear portion of the lock piece 82 is attached to a power switch 54 suitable to selectively break the electrical circuit from the power source through the electric motor 44, for example a switch having two contacts. The contacts are arranged in relation to the electrical circuit feeding the motor such that in the operating position, an uninterrupted flow of current is allowed from the source to the electric motor 44, and in the locking position the continuity of the electrical circuit is broken ensuring that the motor propelling the arbour 12 can not be accidentally engaged.

When the angle grinder is in operation, lock piece 82 is retained in the operating position by the bias of a spring 78 mounted on the front face of the lock piece 82. In this position, access aperture 52 is not positioned above the head of the retaining bolt 24 and tang 74 is not engaged in crenelations 76. In the operating position the access aperture 52 is covered by the grinder housing 84 such that debris is blocked from entering the housing 84. The solid top surface of the lock piece 82 abutting against the rim of both housing 84 apertures 85 and 86 effectively seals the housing 84 against invasive debris.

To change the disk tool 28 manual pressure is applied to the lock piece 82 lever 50 moving the lock piece 82 against the force of the spring 78 thereby positioning the access aperture 52 above the retaining bok 22 head 24 and simultaneously engaging the lock piece 82 tang 74 into the crenelations 76 to lock the arbour 12 against rotation. This allows access to the head of the bolt 24 using a tool via the access aperture 52. The forward movement of the lock piece 82 to the locking position also positions the power switch 54 such that the electrical circuit between the power source and the electric motor 44 is broken thereby preventing accidental operation of the grinder 10 during disk tool 28 removal and resulting damage to the lock piece 82 tang 74, arbour 12 crenelations 76 and bevel gears 38 and 40.

When the lock piece 82 is in the locking position, a suitable tool 56 may inserted to engage the head 22 of the retaining bok 24. The shaft of tooI 56 may be rotated to loosen and remove retaining bolt 24 from coupling piece 14 which is otherwise locked from rotation as it is keyed into the arbour 12 which in mm is locked from rotation by tang 74 of the lock piece 82 tang 74. The disk tool 28, held only by the friction of the coupling piece 14, is easily removed with the coupling piece 14. The disk tool 28 is easily changed then reattached by lowering the grinder 10 onto the coupling piece 14 with the lower polygonal section of the arbour 12 keying onto the polygonal upper portion of the coupling piece 20. The retaining bolt is tightened into the coupling piece 14 by steadying the grinder with one hand and rotating the tool 56 in a clockwise direction with the other hand. The tool 56 is removed from the access aperture 52 and the force of the spring 78 returns the lock piece 82 to the non access position and enables the power circuit via the power switch 54.

The top lock mechanism has the advantage of a safe and simple construction with easy disk tool 28 installation and removal. The power switch 54 prevents accidental operation of the grinder 10 during disk tool 28 installation and removal. The top lock mechanism allows access to the top of the grinder for disk tool 28 changing which is more convenient and faster than conventional bottom locking mechanisms. Moreover, the head of the bolt 22 is not exposed to damage as in bottom locking grinders.

It will be appreciated that the reversible electric motor 44 may be replaced with a unidirectional electric motor impelling a pneumatic system whereby a manual valve controls shaft rotation direction in both forward and reverse directions.

It will be appreciated by those skilled in the art that variations of the preferred embodiment may also be practiced without departing from the scope of the invention.

What is claimed is:

1. An angle grinder for rotating a disk tool mounted at a tool end of a power tool comprising:

a housing;

a substantially hollow arbour mounted for rotation within said housing, said arbour having a tool end;

drive means in contact with said arbour for rotating the arbour;

a retaining bolt having a head and a threaded end, said head being disposed at an end of said power tool opposite said tool end, and said retaining bolt extending substantially through the longitudinal extent of said arbour such that said threaded end of said bolt is disposed at the tool end of said arbour;

said arbour including an annular flange for frictionally engaging a first side of said disk tool; and, means for coupling said arbour to said retaining bolt and for engaging a second side of said disk tool, said means for coupling including an enlarged recess at the tool end of said arbour and a coupling piece adapted to be releasably engaged in said recess to simultaneously couple said arbour to said retaining bolt by frictional engagement with an interior surface of said arbour and engage said second side of said disk tool.

2. An angle grinder for rotating a disk tool mounted at a tool end of a power tool comprising:

a housing;

a substantially hollow arbour mounted for rotation within said housing;

drive means in contact with said arbour for rotating the arbour;

a retaining bolt having a head and a threaded end, said head being disposed at an end of said power tool opposite said tool end, and said retaining bolt extending substantially through the longitudinal extent of said arbour such that said threaded end of said bolt is disposed at the tool end of said arbour:

said arbour including an annular flange for frictionally engaging a first side of said disk tool; and, means for coupling said arbour to said retaining bolt and for engaging a second side of said disk tool, including an enlarged recess at the tool end of said arbour and a coupling piece adapted to be releasably engaged in said recess to simultaneously couple said arbour to said retaining bolt by frictional engagement with an interior surface of said arbour and retain said disk tool between a flange on said coupling piece and said annular flange.

3. An angle grinder as in claim 2 wherein said flange on said coupling piece is disk shaped, and said coupling piece further includes an engagement portion extending radially from the central portion of said disk shaped flange, said engagement portion having a hollow interior threaded to receive said threaded end of said bolt.

4. An angle grinder as in claim 3 wherein said enlarged recess at said tool end of said arbour includes interior polygonal walls and said engagement portion includes exterior polygonal walls corresponding in size and shape to said interior polygonal walls of said enlarged recess so as to enable coupling engagement of said coupling piece in said enlarged recess, and said housing includes a reversible motor for selectively driving said rotation of said disk tool in a clockwise or anti-clockwise direction, whereby said coupling piece simultaneously couples said arbour to said retaining bolt and retains said disk tool between said disk shaped flange of said coupling piece and said annular flange of said arbour. rotation.

5. In an angle grinder for rotating a disk tool mounted at a tool end of said grinder having:

a housing;

a substantially hollow arbour having a tool end, a head opposite said tool end, and a rim about said head; and, a retaining bolt having a head and a threaded end and extending longitudinally through said arbour such that said threaded end of said bolt is disposed at the tool end of said arbour;

an arbour locking mechanism comprising:

a lock piece slidingly mounted in said housing to slide in a direction perpendicular to the longitudinal axis of said arbour toward said rim;

crenelations in said rim;

a tang extending downward from said lock piece, said tang being of a shape adapted to allow the tang to engage said crenelations, whereby said tang is engaged in one of said crenelations when said lock piece is slid toward said rim whereby to effectively lock said arbour against rotation.

6. An arbour locking mechanism as in claim 5 wherein said lock piece includes an aperture sufficiently wide to engage a bolt engaging tool therethrough and said aperture is located on said lock piece such that when said lock piece is slid toward said rim, said aperture is positioned directly over the head of said retaining bolt.

7. An arbour locking mechanism as in claim 6 further comprising a spring biasing said lock piece away from said rim.

8. An arbour locking mechanism as in claim 5 wherein said tang is rectangular in cross section.

9. An arbour locking mechanism as in claim 8 wherein said tang is beveled whereby to facilitate engagement of said tang into said crenelations.

10. An arbour locking mechanism as in claim 9 further comprising a lever extending from the top of said lock piece.

11. An angle grinder for rotating a disk tool mounted at a tool end of a power tool comprising:

a housing;

a substantially hollow arbour mounted for rotation within said housing, said arbour having a tool end, a head opposite said tool end, a rim about said head and an annular flange for frictionally engaging a first side of said disk tool;

a retaining bolt having a head and a threaded end, extending longitudinally through said arbour such that said threaded end of said bolt is disposed at the tool end of said arbour;

means for coupling said arbour to said retaining bolt comprising an enlarged recess at the tool end of said arbour, a coupling piece adapted to be releasably engaged in said enlarged recess and a flange on said coupling piece for engaging a second side of said disk tool, whereby said coupling piece simultaneously couples said arbour to said retaining bolt and retains said disk tool between said flange on said coupling piece and said annular flange;

a lock piece slidingly mounted in said housing to slide in a direction perpendicular to the longitudinal axis of said arbour toward said rim; crenelations in said rim;

a tang extending downward from said lock piece, said tang being of a shape adapted to allow the tang to engage said crenelations, whereby said tang is engaged in one of said crenelations when said lock piece is slid toward said rim whereby to effectively lock said arbour against rotation.

* * * * *

UNITED STATES PATENT AND TRADEMARK OFFICE

CERTIFICATE OF CORRECTION

PATENT NO. : 5,718,621

DATED : February 17, 1998

INVENTOR(S) : Edward Michael Turley

It is certified that error appears in the above-indentified patent and that said Letters Patent is hereby corrected as shown below:

Claim 4:
Column 8, line 47, delete "rotation."

Claim 11:
Column 10, line 16, "crenelations in said rim;" should be a separate line.

Signed and Sealed this

Thirtieth Day of June, 1998

*Attest:*

*Attesting Officer*

BRUCE LEHMAN

*Commissioner of Patents and Trademarks*